United States Patent [19]

Lang

[11] Patent Number: 4,794,888

[45] Date of Patent: Jan. 3, 1989

[54] FUEL PUDDLE SUCTION SYSTEM FOR FUEL INJECTED ENGINE

[75] Inventor: William P. Lang, Oshkosh, Wis.

[73] Assignee: Brunswick Corporation, Skokie, Ill.

[21] Appl. No.: 140,650

[22] Filed: Jan. 4, 1988

[51] Int. Cl.[4] ..... F02B 33/04

[52] U.S. Cl. ..... 123/73 SC; 123/514

[58] Field of Search ..... 123/514, 73 SC, 73 A, 123/73 PP, 478

[56] References Cited

U.S. PATENT DOCUMENTS

| | | | |
|---|---|---|---|
| 4,290,394 | 9/1981 | Frank et al. | 123/73 A |
| 4,461,260 | 7/1984 | Nonaka et al. | 123/73 A |
| 4,590,897 | 5/1986 | Hundertmark | 123/73 A |
| 4,699,109 | 10/1987 | Hensel | 123/458 |

FOREIGN PATENT DOCUMENTS

| | | | |
|---|---|---|---|
| 0181962 | 11/1982 | Japan | 123/514 |
| 0032937 | 2/1983 | Japan | 123/514 |

*Primary Examiner*—Charles J. Myhre
*Assistant Examiner*—David A. Okonsky
*Attorney, Agent, or Firm*—Andrus, Sceales, Starke & Sawall

[57] ABSTRACT

A marine fuel injection system for a two cycle crankcase compression internal combustion engine includes a puddled fuel return line (44) having an outlet (**44*b*) in the excess fuel return line (43) from the fuel injector (24) and pressure regulator (26) to the vapor separator (33) and high pressure fuel pump (25) for recirculation. Excess fuel return flow creates a vacuum at the outlet (44*b*) of the puddled fuel return line (44) to suction puddled fuel therethrough for recirculation together with the excess fuel to the fuel pump (25). The end (44*d*) of the puddled fuel return line (44) at the outlet (44*b*) extends within and parallel to the excess fuel return line (43) to occupy a portion of the cross sectional area of the latter to reduce such cross-sectional area and create a venturi in the excess fuel return line (43) at the outlet (44*b*) of the puddled fuel return line (44**).

6 Claims, 2 Drawing Sheets

FUEL PUDDLE SUCTION SYSTEM FOR FUEL INJECTED ENGINE

BACKGROUND AND SUMMARY

The invention relates to a marine fuel system for a fuel injected engine, and more particularly to a system for removing and recirculating fuel puddles including heavy fuel ends from low points in the crankcase.

In two cycle internal combustion engines, at idle speed, heavy fuel ends condense on the walls of the crankcase and accumulate in the lowest part of the crankcase i.e. form fuel puddles. Various systems are known for recirculating the puddled fuel back into the crankcase for subsequent combustion. For example, the puddled fuel in the crankcase of one of the cylinders is pumped out during the combustion power stroke of the piston in that cylinder pressurizing that section of the crankcase, and the puddled fuel is supplied to the crankcase of another cylinder whose piston is in its charging stroke thus creating a vacuum drawing fuel into that section of the crankcase. In other systems, the puddled fuel is recirculated with the fresh incoming fuel.

In fuel injected engines, it is important to accurately control the quantity of fuel delivered to the engine through the fuel injectors. It is common to use a high pressure pump to supply fuel to the injectors with a pressure regulator providing an essentially constant fuel pressure at the injector. Excess fuel, i.e. the amount over and above that required by the engine, is recirculated, usually through a vapor separator, back to the fuel pump.

In the present invention, the returned excess fuel flow from the fuel injectors to the fuel pump is used to create a vacuum for suctioning puddled fuel from the engine crankcase. In preferred form, the puddled fuel return line is connected to the excess fuel return line by a venturi in the latter.

DESCRIPTION OF PRIOR ART

Figure 1:
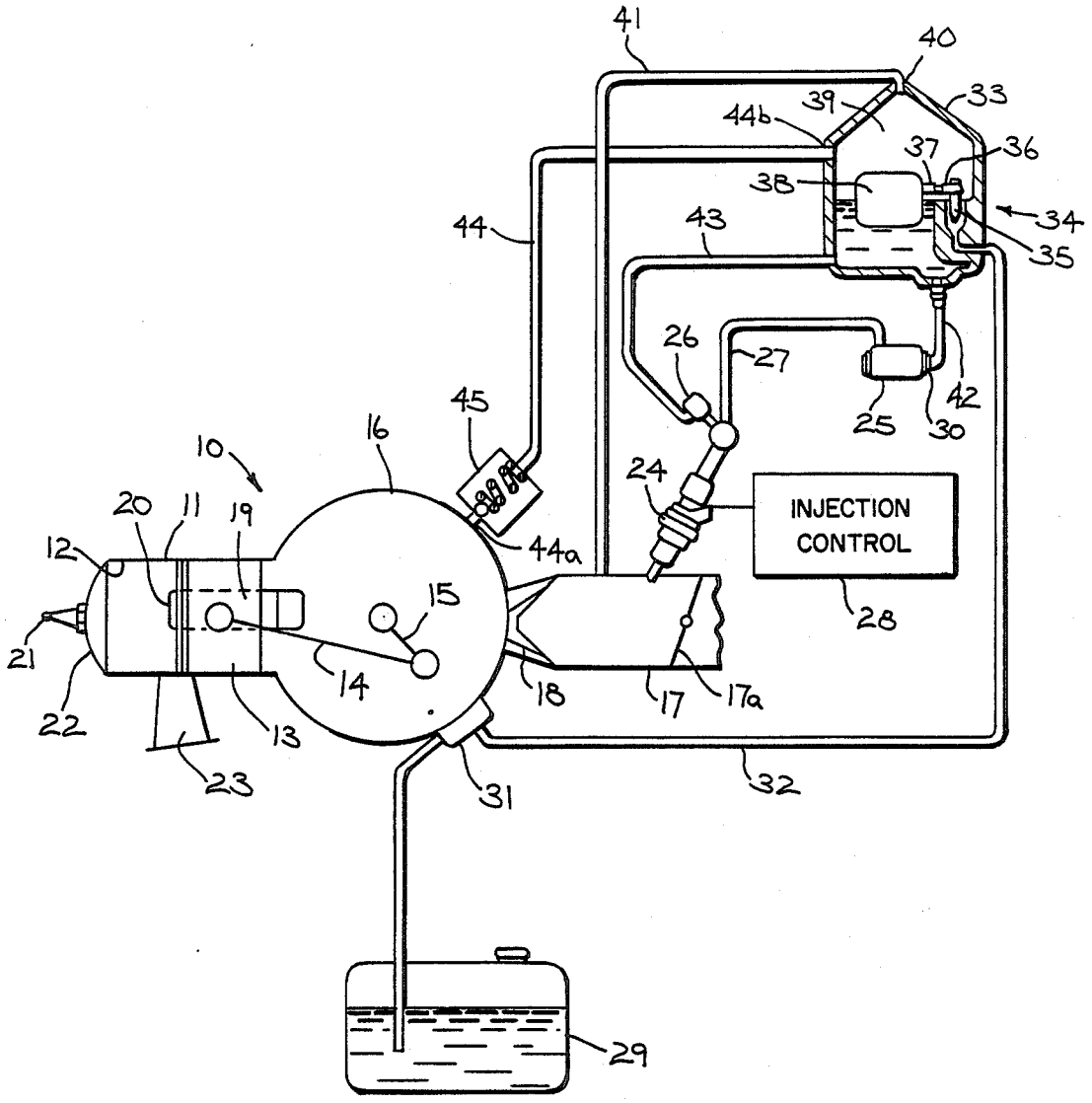
FIG. 1 PRIOR ART
FIG. 1 schematically illustrates a marine fuel system for a fuel injected engine, as known in the prior art.

FIG. 1 shows one cylinder of a two cycle crankcase compression internal combustion engine 10. The engine includes a cylinder block 11 having a cylinder bore 12 in which a piston 13 is supported for reciprocation. The piston 13 is connected by connecting rod 14 to crankshaft 15 which is journaled for rotation in crankcase 16 of engine 10. The engine includes an induction system with air intake manifold 17 having throttle valve 17*a* and supplying combustion air to crankcase 16. One-way reed check valve 18 permits flow from manifold 17 into crankcase 16, and prevents reverse flow out of crankcase 16 into manifold 17. A transfer passage 19 extends from crankcase 16 through cylinder block 11 and terminates at inlet port 20 in the cylinder wall at a point above the bottom dead center position of piston 13. A spark plug 21 is provided in the cylinder head 22 for firing the fuel-air charge. An exhaust port 23 is formed in cylinder bore 12 to discharge exhaust gases to the atmosphere.

Engine 10 is provided with a fuel injection system that includes an electromagnetically controlled injection nozzle 24 that discharges into induction manifold 17. Fuel, typically gasoline, is supplied to nozzle 24 by a high pressure fuel pump 25. A pressure regulator 26 is provided on the fuel supply line 27 to maintain an essentially constant fuel pressure at fuel injection nozzle 24. An electronic control 28 is provided to control the operation of injection nozzle 24 in known manner to deliver the desired amount of fuel to induction manifold 17 at the desired times.

During running of the engine, air is delivered to induction manifold 17 and fuel is injected by nozzle 24 to provide a fuel-air mixture which is admitted to crankcase 16 through reed valve 18 while piston 13 is moving upwardly toward spark plug 21. Reed valve 18 will open during these conditions as long as the pressure in crankcase 16 is lower than that in induction manifold 17. As piston 13 moves downwardly toward crankcase 16, exhaust port 23 will open to discharge spent combustion products, and intake port 20 will open to allow transfer to fuel-air mixture from crankcase 16 to cylinder 12. On the upstroke of piston 13, spark plug 21 is fired to ignite the mixture, and the cycle continues in conventional manner.

A vapor free supply of fuel from a remote fuel tank 29 is provided to the inlet 30 of high pressure fuel pump 25. A low pressure fuel pump 31, such as a diaphragm pump operated by the pulsating pressure in the engine's crankcase 16, is used to draw fuel from fuel tank 29. Such diaphragm pumps are commonly used on outboard motors and produce a fuel output closely matched to engine requirements. From the lower pressure pump 31 fuel is supplied by a fuel line 32 to a vapor separator 33. Admission of fuel from low pressure pump 31 to vapor separator 33 is controlled by a float operated valve 34. The valve member 35 is controlled by a lever 36 having a pivot point 37 fixed on the vapor separator 33 and attached to a float 38. The level of fuel in the vapor separator chamber 39 is thus controlled by the float operated valve 34. An opening 40 at the top of vapor separator chamber 39 is connected by a line 41 to induction manifold 17. The inlet 30 of high pressure fuel pump 25 is connected by fuel line 42 to draw fuel from the bottom of the vapor separator chamber 39. An excess fuel return line 43 from pressure regulator 26 returns excess fuel to the vapor separator chamber 39 for recirculation.

A puddled fuel return line 44 has an inlet 44*a* connected to a low point of crankcase 16 and has an outlet 44*b* connected to vapor separator 33. Other puddle return fuel lines are connected to vapor separator 33 from each crankcase section of the respective remaining cylinders of the engine for recirculation of puddled fuel including heavy fuel ends. During the combustion power stroke of piston 13 away from spark plug 21, the puddled fuel is pumped from crankcase 16 through one-way check valve 45 to vapor separator 33 for recirculation. Valve 45 prevents reverse flow through line 44 back into crankcase 16.

In operation, low pressure fuel pump 31 supplies fuel to vapor separator 33 through float controlled valve 34. The pressure in vapor separator 33 at the surface of the fuel will be held at or below atmospheric pressure by the connection through line 41 to induction manifold 17. Thus, fuel which vaporizes will be drawn from separator 33 and supplied through line 41 to induction manifold 17. Hence, vapor free fuel will be supplied through line 42 to inlet 30 of high pressure fuel injection pump 25. Separator 33 is also effective to remove vapors from the excess fuel returned to separator 33 from pressure regulator 26 through excess fuel return line 43. Separator 33 is also effective to remove vapors from the puddled fuel returned to separator 33 from crankcase 16 through puddled fuel return line 44.

DESCRIPTION OF THE INVENTION

Figure 2:
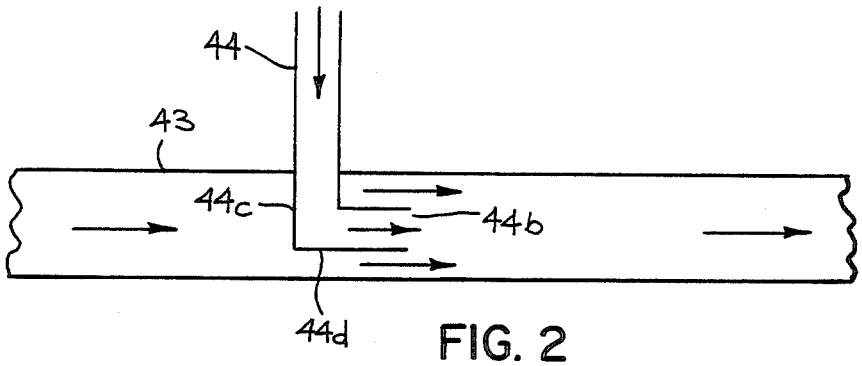
FIG. 2 shows a puddle removal system in accordance with the invention for the fuel system of FIG. 1.

In the present invention, puddled fuel return line outlet 44*b* is connected to excess fuel return line 43, rather than to vapor separator 33 and rather than to one of the other crankcase sections of the engine. In FIG. 2, excess fuel in line 43 flows left to right from fuel injector 24 and pressure regulator 26 to vapor separator 33. The excess fuel return flow creates a vacuum at outlet 44*b* of puddled fuel return line 44 to suction puddled fuel therethrough for recirculation to vapor separator 33 and high pressure fuel pump 25.

Figure 3:
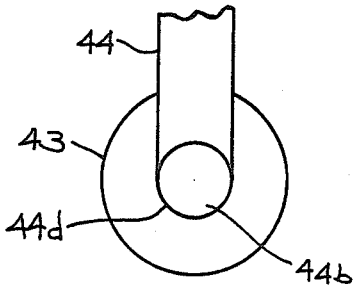
FIG. 3 is a view taken along line 3—3 of FIG. 2.

Puddled fuel return line 44 is preferably connected to excess fuel return line 43 by a venturi in the latter. Outlet 44*b* is within excess fuel return line 43 and occupies a portion of the cross-sectional area of the latter to reduce such cross-sectional area and create a venturi in excess feel return line 43 at outlet 44*b* of puddled fuel return line 44. Puddled fuel return line 44 has a portion 44*c* extending into excess fuel return line 43 and a portion 44*d* extending parallel to excess fuel return line 43. Excess fuel return line 43 is concentric to the puddled fuel return line at portion 44*d* at outlet 44*b*, FIG. 3.

In the preferred embodiment, the invention is used in combination with the vapor separator 33. It is also preferred that the invention be used in combination with one-way check valve 45 in puddled fuel return line 44 permitting flow to excess fuel return line 43 and blocking reverse flow.

It is recognized that various equivalents, alternatives and modifications are possible within the scope of the appended claims.

I claim:

1. A marine fuel system for a two cycle crankcase compression internal combustion engine having an induction system for supplying combustion air to the engine and fuel injection means for mixing fuel with the combustion air, and having a fuel tank, said fuel system comprising fuel pump means connected to draw fuel from said fuel tan and supply fuel under pressure to said fuel injection means, pressure regulator means regulating the output pressure of said fuel pump means at said fuel injection means and returning excess fuel through an excess fuel return line to said fuel pump means for recirculation, a puddle removal system comprising a puddled fuel return line having an inlet connected to said crankcase and receiving puddled fuel including heavy fuel ends, and having an outlet connected to said excess fuel return line such that excess fuel flow from said full injection means back to said fuel pump means through said excess fuel return line creates a vacuum at said outlet of said puddled fuel return line to suction puddled fuel therethrough for recirculation to said fuel pump means.

2. The invention according to claim 1 wherein said puddled fuel return line is connected to said excess fuel return line by venturi means in the latter.

3. The invention according to claim 2 wherein said outlet of said puddled fuel return line is within said excess fuel return line and occupies a portion of the cross-sectional area of the latter to reduce said cross-sectional area and create a venturi in said excess fuel return line at said outlet of said puddled fuel return line.

4. The invention according to claim 3 wherein said puddled fuel return line has a portion extending into said excess fuel return line and a portion extending parallel to said excess fuel return line, said excess fuel return line being concentric to said puddled fuel return line at said outlet of said puddled fuel return line.

5. The invention according to claim 1 wherein said fuel pump means comprises a first fuel pump connected to draw fuel from said fuel tank and a second fuel pump connected to receive fuel from said first pump and provide fuel under pressure to said fuel injection means, a vapor separator connected between said first and second fuel pumps to remove fuel vapors supplied to said second pump, and wherein said excess fuel return line returns excess fuel and puddled fuel to said vapor separator.

6. The invention according to claim 1 comprising a one-way valve in said puddled fuel return line permitting flow to said excess fuel return line and blocking reverse flow.

* * * * *